US011407540B2

(12) United States Patent
Hordijk et al.

(10) Patent No.: US 11,407,540 B2
(45) Date of Patent: Aug. 9, 2022

(54) PACKAGING DEVICE FOR ROUND ARTICLES SUCH AS EGGS

(71) Applicant: SANOVO TECHNOLOGY NETHERLANDS B.V., Aalten (NL)

(72) Inventors: Jan Hordijk, Aalten (NL); Peter Anton Van Asselt, Aalten (NL); Dirk Willem Wikkerink, Aalten (NL)

(73) Assignee: SANOVO TECHNOLOGY NETHERLANDS B.V., Aalten (NL)

( * ) Notice: Subject to any disclaimer, the term of this patent is extended or adjusted under 35 U.S.C. 154(b) by 178 days.

(21) Appl. No.: 16/617,609

(22) PCT Filed: May 30, 2018

(86) PCT No.: PCT/NL2018/050354
§ 371 (c)(1),
(2) Date: Nov. 27, 2019

(87) PCT Pub. No.: WO2018/222037
PCT Pub. Date: Dec. 6, 2018

(65) Prior Publication Data

US 2020/0102106 A1 Apr. 2, 2020

(30) Foreign Application Priority Data

Jun. 1, 2017 (NL) ..... 2019010

(51) Int. Cl.
*B65B 23/08* (2006.01)

(52) U.S. Cl.
CPC ..... *B65B 23/08* (2013.01)

(58) Field of Classification Search
CPC .. B65B 23/06; B65B 23/08; B65G 2201/0208
(Continued)

(56) References Cited

U.S. PATENT DOCUMENTS 5,232,080 A * 8/1993 van Essen ..... B65B 65/02 198/418.6

FOREIGN PATENT DOCUMENTS

EP 0 3 90 241 10/1990
EP 1 201 542 5/2002
(Continued)

OTHER PUBLICATIONS

International Search Report for PCT/NL2018/050354, dated Jul. 19, 2018.
Written Opinion for PCT/NL2018/050354, dated Jul. 19, 2018.

*Primary Examiner* — Chelsea E Stinson
(74) *Attorney, Agent, or Firm* — Nixon Peabody LLP; Jeffrey L. Costellia

(57) ABSTRACT

A packaging device (1) for packaging substantially round articles into a dimpled package (100) having an array of pockets to receive the round articles. The packaging device comprising a supply conveyor (2) for the articles and a package conveyor (15) located below the supply conveyor for conveying the packages. A filling buffer (4) is located between the supply conveyor and the package conveyor having multiple sub-buffers (5). The device furthermore comprises a collector (8) for receiving articles from the buffer, and a setter (12) wherein, in use, the setter reciprocates between an upper position to a lower position, wherein in the upper position the articles can be received from the collector and in the lower position the articles can be discharged into the pockets of the package. The collector comprises a plurality of collector rows, wherein the collector is configured and arranged to move each one of the plurality of collector rows back and forth underneath the filling buffer to a position under any one of the sub-buffers for receiving articles from the lowest row thereof, and to move back and
(Continued)

forth with filled pockets to a position above the setter to discharge the articles into the setter.

18 Claims, 10 Drawing Sheets

(58) Field of Classification Search
USPC ..... 53/539
See application file for complete search history.

(56) References Cited

FOREIGN PATENT DOCUMENTS

| | | | | |
|---|---|---|---|---|
| EP | 1 310 429 | | 5/2003 | |
| EP | 1310429 | A1 * | 5/2003 | ..... B65B 23/06 |

* cited by examiner

PACKAGING DEVICE FOR ROUND ARTICLES SUCH AS EGGS

FIELD OF THE INVENTION

The present invention relates to a packaging device for packaging substantially round articles, such as eggs or fruit, into a dimpled package. Such a dimpled package typically has an array of pockets comprising rows and columns, to receive the round articles.

BACKGROUND OF THE INVENTION

EP 1310429 discloses a packaging device comprising a supply conveyor for conveying the articles, in this case eggs, in a first direction and a package conveyor located below the supply conveyor for conveying the packages in a second direction substantially perpendicular to the first direction. A filling buffer is located between the supply conveyor and the package conveyor, wherein the filling buffer in use is filled from above with articles by the supply conveyor and fills the packages on the package conveyor located below the buffer with said articles. A collector comprising a row of releasable pockets is arranged to receive the articles from the filling buffer. A setter comprising a row of releasable pockets is arranged to receive articles from the collector and is movable up and down in a third direction perpendicular to the first direction and second direction. The setter reciprocates between an upper position to a lower position, wherein in the upper position the articles can be received from the collector and in the lower position the articles can be discharged into the pockets of the package.

The present invention seeks to provide a packaging device as mentioned at the outset which has a higher capacity in terms of number of articles to be handled.

SUMMARY OF THE INVENTION

In one aspect the invention relates to a packaging device for packaging substantially round articles, such as eggs or fruit, into a dimpled package having an array of pockets to receive the round articles, wherein said array comprises rows and columns. The packaging device comprises a supply conveyor for conveying the articles in a first direction (X) and having article holders for releasably holding the articles; and a package conveyor located below the supply conveyor for conveying the packages in a second direction (Y) substantially perpendicular to the first direction (X), the packages being oriented on the package conveyor such that the rows of the package extend in the first direction (X) and the columns of the package extend in the second direction (Y). A filling buffer is located between the supply conveyor and the package conveyor. The filling buffer in use is filled from above with articles by the supply conveyor and fills the packages on the package conveyor located below the buffer with said articles. The filling buffer comprises a plurality of parallel sub-buffers positioned next to each other seen in the second direction (Y). Each sub-buffer has a plurality of stacked sub-buffer rows of releasable buffer pockets said sub-buffer rows extending in the first direction (X) and each having a number of buffer pockets equal or greater than the number of pockets in a package row extending in the first direction (X). The packaging device furthermore comprises a collector comprising a row of releasable pockets defining a collector row which is movable in the second direction (Y); and a setter comprising a row of releasable pockets defining a setter row which is movable up and down in a third direction (Z) perpendicular to the first direction (X) and second direction (Y). In use, the setter reciprocates between an upper position to a lower position, wherein in the upper position the articles can be received from the collector and in the lower position the articles can be discharged into the pockets of the package. The collector comprises a plurality of collector rows, wherein the collector is configured and arranged to move each one of the plurality of collector rows back and forth in the second direction (Y) underneath the filling buffer to a position under any one of the sub-buffers for receiving articles from the lowest row thereof, and to move back and forth in the second direction (Y) with filled pockets to a position above the setter to discharge the articles into the setter.

According to this aspect of the invention the collector comprises a plurality of collector rows. The collector can move each one of the plurality of collector rows back and forth in the second direction (Y) underneath the filling buffer to a position under any one of the sub-buffers. Thus each one of the collector rows can be moved selectively to align with any one of the sub-buffers, such that it can receive articles from the lowest row of the selected sub-buffer. When articles are received in at least one of the collector rows of the collector, this row can be moved back and forth in the second direction (Y) with filled pockets to a position above the setter to discharge the articles into the setter.

In a possible embodiment the collector rows of said plurality of collector rows are moveable independently from each other. In this embodiment the collector rows are moved selectively and independent from each other to a sub-buffer with a full lower row. In this embodiment the device can have a separate driving mechanism for each collector row or a common driving mechanism with a selective driving transmission. If for example the collector has two collector rows, one of the collector rows can hold articles and be moved towards the setter while the other collector row is empty because it discharged articles just before. Thus while the one collector row is moved to discharge the articles in the setter, the other can in the meantime be moved towards a sub-buffer with a filled lower row. This increases the rate at which the articles can be packed, and thus the throughput time of the packages. This results in an increase of capacity.

It is envisaged that the independently moveable collector rows move in the same plane. Therefore an embodiment is envisaged in which a controller, that controls the movement of the collector rows, is configured such that it prevents the rows from colliding.

In another possible embodiment the collector rows of said plurality of collector rows are coupled to each other so as to move together. This coupling can be mechanical coupling, e.g. by a connecting member interconnecting the collector rows. In this embodiment only one driving mechanism is needed to move the collector rows. If for example the collector has two collector rows, one of the collector rows can hold articles and moved towards the setter while the other collector row is empty because it discharged articles just before. Thus while the one collector row is moving empty, the other moves to discharge the articles in the setter. If the empty row passes a full buffer row, it can receive the articles form said buffer row and then move on to discharge the articles of the other row into the setter. In another situation the filled row can discharge the articles first in the setter, but the other row is then nearer to another row from which articles can be received, which reduces the throughput time of the packages. This will result in a higher capacity.

In a possible embodiment of the packaging device the setter has a single setter row. Thus one row of one package can be filled at a time.

In an alternative embodiment of the packaging device the setter has a plurality of setter rows. Thus a plurality of rows of the package can be filled with articles simultaneously.

The setter rows of said plurality of setter rows may be movable up and down independently. In such an embodiment the rows of one package but also the rows of different packages placed on consecutive positions on the package conveyor can be filled independently by different setter rows.

In another embodiment the setter rows of said plurality of said rows are coupled to each other so as to move together. In this embodiment the pitch between the setter rows is preferably the same as the pitch of the rows in the package, such that multiple package rows can be filled simultaneously.

Another aspect of the invention also relates to a packaging device a packaging device for packaging substantially round articles, such as eggs or fruit, into a dimpled package having an array of pockets to receive the round articles wherein said array comprises rows and columns. The packaging device comprises a supply conveyor for conveying the articles in a first direction (X) and has object holders for releasably holding the articles; and a package conveyor located below the supply conveyor for conveying the packages in a second direction (Y) substantially perpendicular to the first direction (X), the packages being oriented on the package conveyor such that the rows of the package extend in the first direction (X) and the columns of the package extend in the second direction (Y). A filling buffer is located between the supply conveyor and the package conveyor, wherein the filling buffer in use is filled from above with articles by the supply conveyor and fills the packages on the package conveyor located below the buffer with said articles. The filling buffer comprises a plurality of parallel sub-buffers positioned next to each other seen in the second direction (Y). Each sub-buffer has a plurality of stacked sub-buffer rows of releasable buffer pockets, said sub-buffer rows extending in the first direction (X) and each having a number of buffer pockets equal or greater than the number of pockets in a package row extending in the first direction (X). The packaging device furthermore comprises a collector comprising at least one row of releasable pockets defining a collector row which is movable in the second direction (Y); and a setter comprising a row of releasable pockets defining a setter row which is movable up and down in a third direction (Z) perpendicular to the first direction (X) and second direction (Y). In use, the setter reciprocates between an upper position to a lower position, wherein in the upper position the articles can be received from above and in the lower position the articles can be discharged into the pockets of the package. An intermediate transfer device is arranged between the collector and the setter, said intermediate transfer device comprising at least one transfer row of releasable pockets. The intermediate transfer device is configured and arranged to move the transfer row back and forth from a position under the at least one collector row for receiving articles to a position above the setter row to discharge the articles into the setter.

According to this aspect of the invention an intermediate transfer device is arranged between the collector and the setter. The intermediate transfer device comprises at least one transfer row of releasable pockets. The intermediate transfer device is configured and arranged to move the transfer row back and forth from a position under the at least one collector row for receiving articles to a position above the setter row to discharge the articles into the setter.

In a preferred embodiment the collector comprises at least two collector rows. These collector rows may be coupled so as to move in the second direction (Y) together, or alternatively, may be movable in the second direction (Y) independently from each other.

In a possible embodiment the transfer device comprises at least one pair of transfer rows wherein the transfer device is configured and arranged to move each one of the transfer rows of the pair back and forth from a position under said at least one collector row for receiving articles therefrom, to a position above the setter row to discharge the articles into the setter.

In a possible embodiment the transfer rows of said pair of transfer rows are each arranged on a corresponding swivelling arm whereby the movement of the transfer rows is a swivelling movement which is composed of a movement in the second direction (Y) and the third direction (Z).

In a possible embodiment the pitch between the pockets of the at least one transfer row is variable in the first direction (X) such that it can be adapted to the pitch of the at least one collector row for receiving the articles and to the pitch of the setter row for discharging the articles. Preferably the pitch is varied during the movement from the position under the collector to the position above the setter and vice versa.

If the supply conveyor (egg chain) only has two rows, and thus the filling buffer only has two sub-buffers, a collector may be omitted. In a packaging device according to this aspect the eggs (or other articles) can be released directly from the lowest row of the sub-buffers into the releasable pockets of the transfer rows of the transfer device. Such a packaging device is defined as follows:

A packaging device for packaging substantially round articles, such as eggs or fruit, into a dimpled package having an array of pockets to receive the round articles, wherein said array comprises rows and columns. The packaging device comprises a supply conveyor for conveying the articles in a first direction (X) and has object holders for releasably holding the articles; and a package conveyor located below the supply conveyor for conveying the packages in a second direction (Y) substantially perpendicular to the first direction (X), the packages being oriented on the package conveyor such that the rows of the package extend in the first direction (X) and the columns of the package extend in the second direction (Y). A filling buffer is located between the supply conveyor and the package conveyor, wherein the filling buffer in use is filled from above with articles by the supply conveyor and fills the packages on the package conveyor located below the buffer with said articles. The filling buffer comprises a plurality of parallel sub-buffers positioned next to each other seen in the second direction (Y). Each sub-buffer has a plurality of stacked sub-buffer rows of releasable buffer pockets. The sub-buffer rows extend in the first direction (X) and each have a number of buffer pockets equal or greater than the number of pockets in a package row extending in the first direction (X). The packaging device furthermore comprises a setter comprising a row of releasable pockets defining a setter row which is movable up and down in a third direction (Z) perpendicular to the first direction (X) and second direction (Y). In use, the setter reciprocates between an upper position to a lower position, wherein in the upper position the articles can be received and in the lower position the articles can be discharged into the pockets of the package. The packaging device furthermore comprises a transfer device comprising at least one pair of transfer rows, and the setter comprises a setter row associated with said pair of transfer rows. The transfer device is configured and arranged to move each one of the transfer rows of the pair back and forth from a position under a sub-buffer associated with said transfer row for receiving articles from the lowest row of said sub-buffer, to a position above the setter row to discharge the articles into the setter.

In a possible embodiment the transfer rows of said pair are each arranged on a corresponding guiding mechanism whereby the movement of the collector rows is a combined movement, which is composed of a movement in the second direction (Y) and the third direction (Z). The guiding mechanism may include a swivelling arm.

In a possible further embodiment the pitch between the pockets of the at least one transfer row is variable in the first direction (X) such that it can be adapted to the pitch of the corresponding sub-buffer of the filling buffer for receiving the articles and to the pitch of the setter row for discharging the articles. The pitch may be varied during the movement from the position under the sub-buffer to the position above the setter and vice versa.

In a further simplified packaging device according to another aspect of the invention it is also possible to omit the setter, such that the transfer device discharges the articles directly in the pocket rows of the package. Such a packaging device is defined as follows:

A packaging device for packaging substantially round articles, such as eggs or fruit into a dimpled package having an array of pockets to receive the round articles, wherein said array comprises rows and columns. The packaging device comprises a supply conveyor for conveying the articles in a first direction (X) and having object holders for releasably holding the articles; and a package conveyor located below the supply conveyor for conveying the packages in a second direction (Y) substantially perpendicular to the first direction (X), the packages being oriented on the package conveyor such that the rows of the package extend in the first direction (X) and the columns of the package extend in the second direction (Y). A filling buffer is located between the supply conveyor and the package conveyor, wherein the filling buffer in use is filled from above with articles by the supply conveyor and fills the packages on the package conveyor located below the buffer with said articles. The filling buffer comprises a plurality of parallel sub-buffers positioned next to each other seen in the second direction (Y). Each sub-buffer has a plurality of stacked sub-buffer rows of releasable buffer pockets. The sub-buffer rows extend in the first direction (X) and each have a number of buffer pockets equal or greater than the number of pockets in a package row extending in the first direction (X). The packaging device furthermore comprises a transfer device comprising at least one pair of transfer rows. The package comprises a package row associated with said pair of transfer rows. The transfer device is configured and arranged to move each one of the transfer rows of the pair back and forth from a position under a sub-buffer associated with said transfer row for receiving articles from the lowest row of said sub-buffer, to a position above the package row to discharge the articles into the package.

In a possible embodiment the transfer rows of said pair are each arranged on a corresponding guiding mechanism whereby the movement of the collector rows is a combined movement, which is composed of a movement in the second direction (Y) and the third direction (Z). The guiding mechanism may include a swivelling arm.

In a possible further embodiment the pitch between the pockets of the at least one transfer row is variable in the first direction (X) such that it can be adapted to the pitch of the corresponding sub-buffer of the filling buffer for receiving the articles and to the pitch of the package row for discharging the articles. The pitch may be varied during the movement from the position under the sub-buffer to the position above the package row and vice versa.

The invention will be elucidated further in the following description with reference to the drawings.

DETAILED DESCRIPTION

Figure 1:
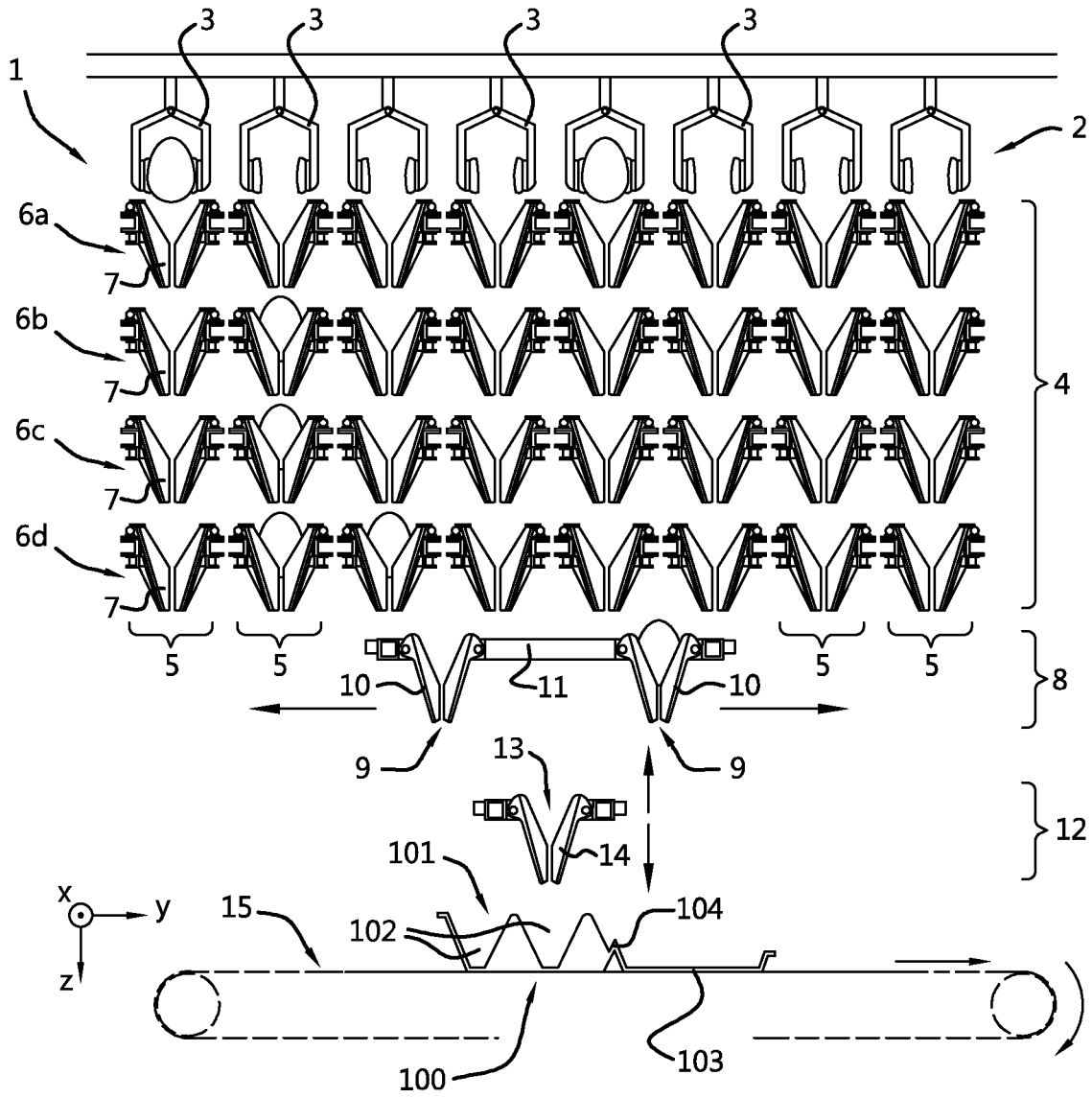
FIG. 1 shows a schematic view of a first embodiment of a packaging device according to the invention.

FIG. 1 shows a schematic front view of a first embodiment of a packaging device 1 for packaging articles, in this case eggs, in a package 100. The package 100 in this example is an egg carton with a dimpled structure 101 defining pockets 102 to receive the eggs, and an integrally formed lid 103 to close the box 100. The lid is connected to the dimpled structure by a hinge 104. The dimpled structure 101 defines an array of pockets having rows extending in an X-direction and columns extending in an Y-direction. In the shown example, the egg carton has two rows of pockets and may have multiple columns; in common egg cartons the number of columns is five (normal carton for ten eggs) or three (a small carton). The package may also have another form, for example an egg tray which has more rows and columns than an egg carton.

It must be noted that there is mentioned an egg carton or a tray is often made of papier-mâché, but that the package may also be made of another material, such as plastic. This is not relevant for the invention.

The packaging device 1 comprises a supply conveyor 2. The supply conveyor 2 includes article holders 3 for releasably holding the eggs. The supply conveyor 2 comprises multiple rows of article holders which are mounted to a chain or another endless element. In the egg handling industry the supply conveyor 2 is often referred to as "egg chain". In the example of FIG. 1 the supply conveyor 2 includes eight parallel rows which extend in the X-direction. The eggs are conveyed by the supply conveyor in the X-direction.

The article holders may be suspended from the chain and have moveable fingers that grip around an article such as an egg. The fingers may be moved to a spread state in which the article is released and falls down.

Below the supply conveyor 2 a filling buffer 4 is arranged. The filling buffer 4 is filled from above with articles by the supply conveyor 2. The filling buffer 4 comprises a plurality of parallel sub-buffers 5 positioned next to each other seen in the Y-direction. Each sub-buffer 5 has a plurality of stacked sub-buffer rows 6 of releasable buffer pockets 7. The sub-buffer rows 6 extend in the X-direction and each have a number of buffer pockets corresponding to the maximum number of pockets in a package row extending in the X-direction. In the example in FIG. 1 the filling buffer 4 has eight sub-buffers 5, and each sub-buffer 5 has four stacked sub-buffer rows 6*a*-6*d*. In case of packaging eggs, each sub-buffer row 6*a*-6*d* may for example have five buffer pockets 7, when for example an egg carton 100 with five columns has to be filled. It is also possible that the sub-buffer row has for example six buffer pockets, but that the software that controls the filling of the sub-buffers only fills five of the buffer pockets if the package has only five columns. In that case the filling buffer can universally be used for filling packages with a different amount of columns, with a maximum of six in the current example.

The filling buffer 4 is stationary. It receives articles, for example eggs, in its upper rows 6*a* from the rows of the supply conveyor 2 which move along it (in the X-direction) and release the article from the respective article holders 3, when the respective article holders 3 are located above an empty pocket 7 of the upper row 6*a* of the corresponding sub-buffer 5.

The articles are passed on from the upper row 6*a* of the sub-buffer 5 to the row 6*b* below it by opening the pockets 7 and releasing the article to a pocket 7 in the row 6*b* directly below it. In the same manner the articles are passed on to the subsequent rows 6*c* below until the article arrives in the lowest row 6*d* of the sub-buffer 5. The buffer 4 is controlled such that an article is only released from a pocket 7 to a pocket 7 below it if the latter is empty and is able receive the article.

Below the buffer 4 a collector 8 is arranged. The collector 8 comprises plurality of collector rows 9 of releasable pockets 10. In the specific embodiment of FIG. 1 the collector 8 has two collector rows 9 which are mechanically coupled by one or more coupling members 11.

Below the collector 8 a setter 12 is arranged. The setter 12 in the specific embodiment of FIG. 1 comprises a single row 13 of releasable pockets 14 defining a setter row 13. The setter row 13 is movable up and down in a Z-direction perpendicular to the X-direction and Y-direction.

Below the setter 12 a package conveyor 15 is located. This may be an endless conveyor such as a belt conveyor on which packages 100 are placed and conveyed in the Y-direction past the setter 12. The packages 100 are oriented on the package conveyor 15 such that the rows of the package 100 extend in the X-direction and the columns of the package 100 extend in the Y-direction.

In use, the setter 12 reciprocates between an upper position to a lower position, wherein in the upper position the articles can be received from the collector 8 and in the lower position the articles can be discharged into the pockets 102 of the package 100 that is positioned by the package conveyor 15 with one package row below the setter row 13.

The collector 8 can move each one of the plurality of collector rows 9 back and forth in the Y-direction underneath the filling buffer 4 to a position under any one of the sub-buffers 5. Thus each one of the collector rows 9 can be moved selectively to align with any one of the sub-buffers 5, such that it can receive articles from the lowest row 6 of the selected sub-buffer 5. When articles are received in at least one of the collector rows 9 of the collector 8, this row 9 can be moved back and forth in the Y-direction with filled pockets 10 to a position above the setter 12 to discharge the articles into the setter 12.

In the first embodiment only one driving mechanism is needed to move the collector rows 9, since these rows are mechanically coupled by coupling member 11. If, like in the example of FIG. 1, the collector 8 has two coupled collector rows 9, one of the collector rows 9 can hold articles and moved towards the setter 12 while the other collector row 9 is empty because it discharged articles just before. Thus while the one collector row 9 is moving empty the other moves to discharge the articles in the setter 12. If the empty row 9 passes a full sub-buffer row 6, it can receive the articles form said buffer row 6 and then move on to discharge the articles of the other collector row 9 into the setter 12. In another situation the filled collector row 9 can discharge the articles first in the setter 12, but the other collector row 9 is then nearer to another sub-buffer row 6 from which articles can be received, which reduces the throughput time of the packages 100.

Figure 2:
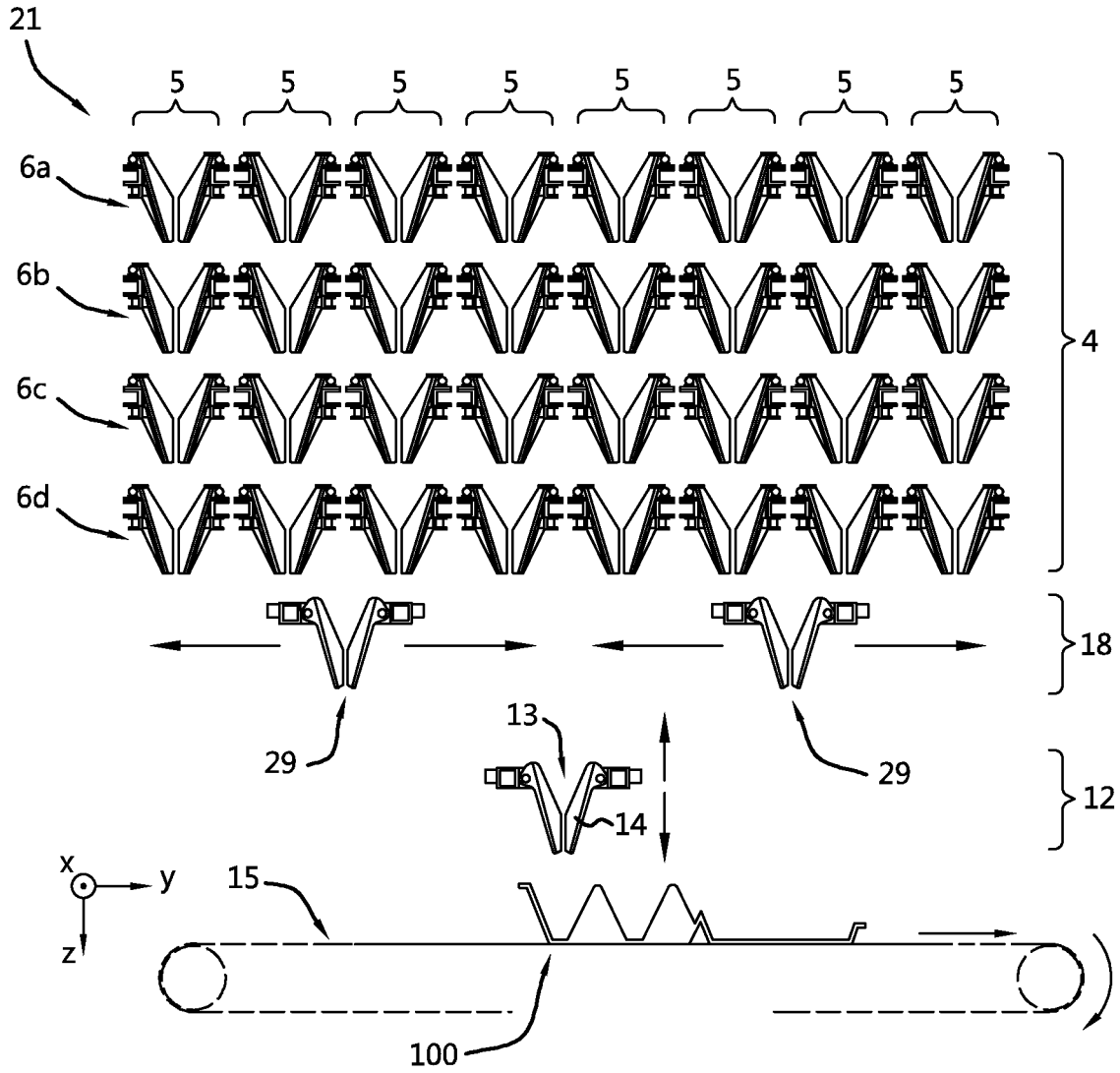
FIG. 2 shows a schematic view of a second embodiment of a packaging device according to the invention.

FIG. 2 shows a schematic front view of a second embodiment of a packaging device 21 for packaging articles, in this case eggs, in a package 100. This packaging device 21 has the same components as the packaging device of the first embodiment. The only difference is in the specific embodiment of the collector, which will described below. The other components are the same and are indicated with the same reference numerals as in the first embodiment. For a description of those same components is referred to the above description of the first embodiment.

The collector of the second embodiment is indicated with reference numeral 28. Contrary to the collector 8 of the first embodiment, the collector 28 of the second embodiment has multiple rows 29, which are moveable in the Y-direction independently from each other. In particular in the embodiment of FIG. 2 the collector has two independently moveable rows 29.

In this second embodiment the collector rows 29 are moved selectively and independent from each other to a sub-buffer 5 with a full lower row 6*d*. In this embodiment the device 21 can have a separate driving mechanism for each collector row 29 or a common driving mechanism with a selective driving transmission. If for example the collector 28 has two collector rows, as is shown in the example of FIG. 2, one of the collector rows 29 can hold articles and be moved towards the setter 12 while the other collector row 29 is empty because it discharged articles just before. Thus while the one collector row 29 is moved to discharge the articles in the setter 12 the other collector row 29 can in the meantime be moved towards a sub-buffer 5 with a filled lower row 6*d*. This increases the rate at which the articles can be packed, and thus the throughput time of the packages 100.

It is envisaged that the independently moveable collector rows 29 move in the same plane. Therefore an embodiment is envisaged in which a controller, that controls the movement of the collector rows 29, is configured such that it prevents the rows 29 from colliding.

Figure 3:
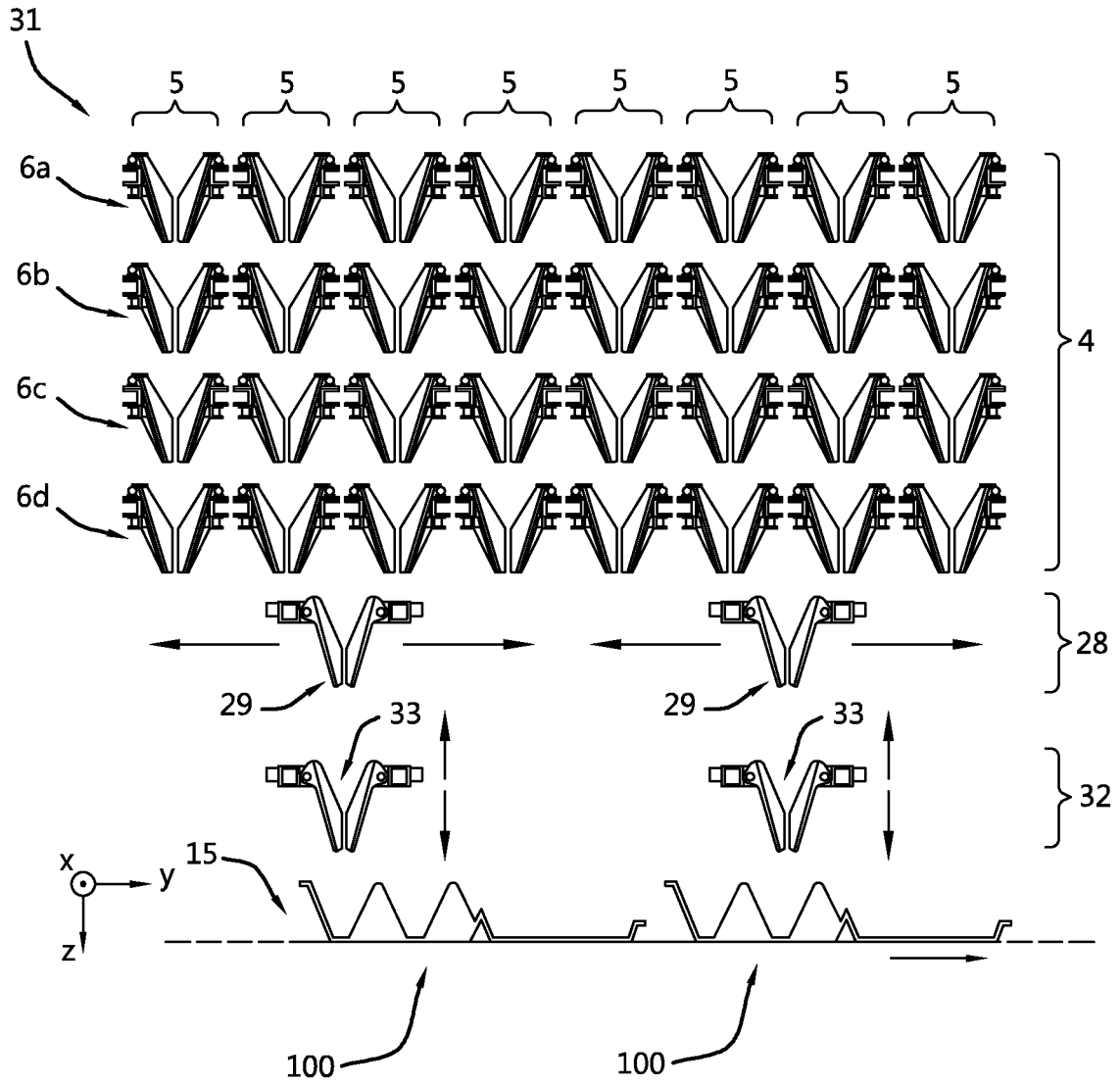
FIG. 3 shows a schematic view of a third embodiment of a packaging device according to the invention.

FIG. 3 shows a schematic front view of a third embodiment of a packaging device for packaging articles, in this case eggs, in a package 100. This packaging device 31 has the same components as the packaging device 21 of the second embodiment. The only difference is in the specific embodiment of the setter, which will described below. The other components are the same and are indicated with the same reference numerals as in the second embodiment. For a description of those same components is referred to the above description of the first embodiment and second embodiment.

The setter of the third embodiment is indicated with reference numeral 32. Contrary to the setter 12 of the second embodiment, the setter 32 of the third embodiment has multiple rows 33, which are moveable in the Z-direction independently from each other.

By this third embodiment the rows of one package 100 but also the rows of different packages 100 placed on consecutive positions on the package conveyor 12 can be filled independently by the different setter rows 33.

Figure 12:
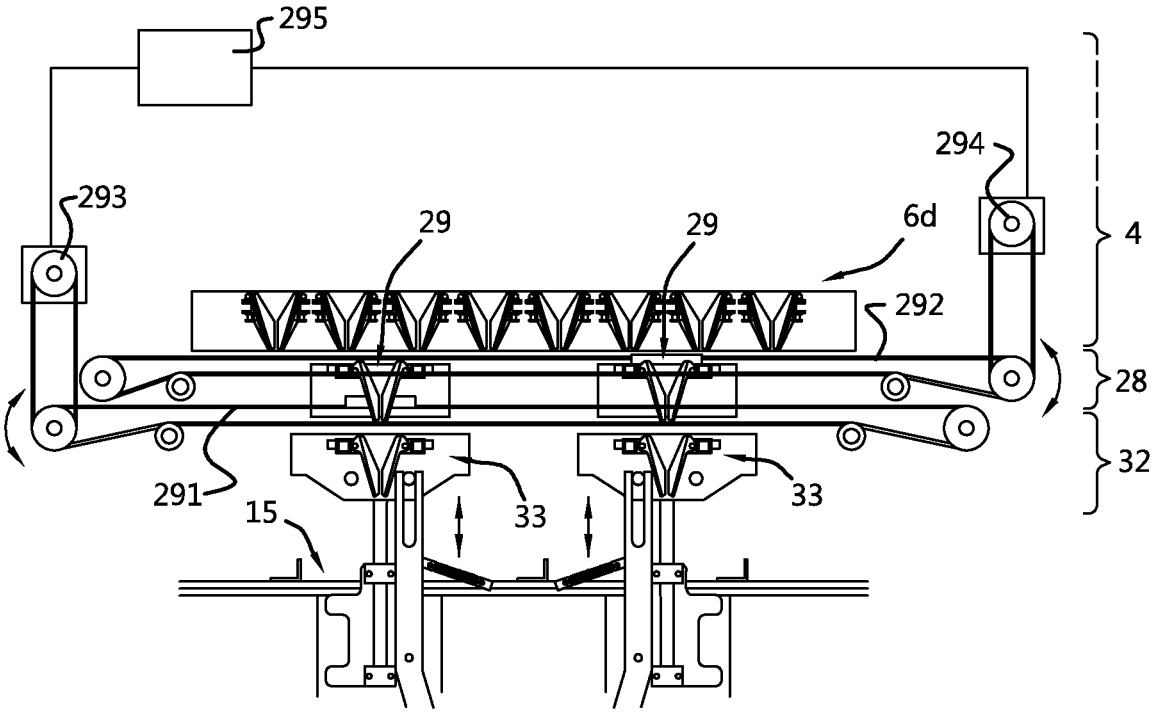
FIG. 12 shows in more detail a part of the third embodiment of FIG. 3.

In FIG. 12 more detail of the third embodiment is shown. From the buffer 4 only the lowest row 6*d* is shown. Most important of this figure is that is shown that the collector rows 29 each have their own drive assembly comprising a belt 291 and 292 respectively and a drive motor 293 and 294 respectively.

The collector rows 29 can be moved independently from each other in the same plane by their associated drive motor 293, 294. A controller 295 is connected to the drive motors 293, 294 and controls the movement of the collector rows 29. The controller 295 is configured such that it prevents the collector rows 29 from colliding.

Figure 4:
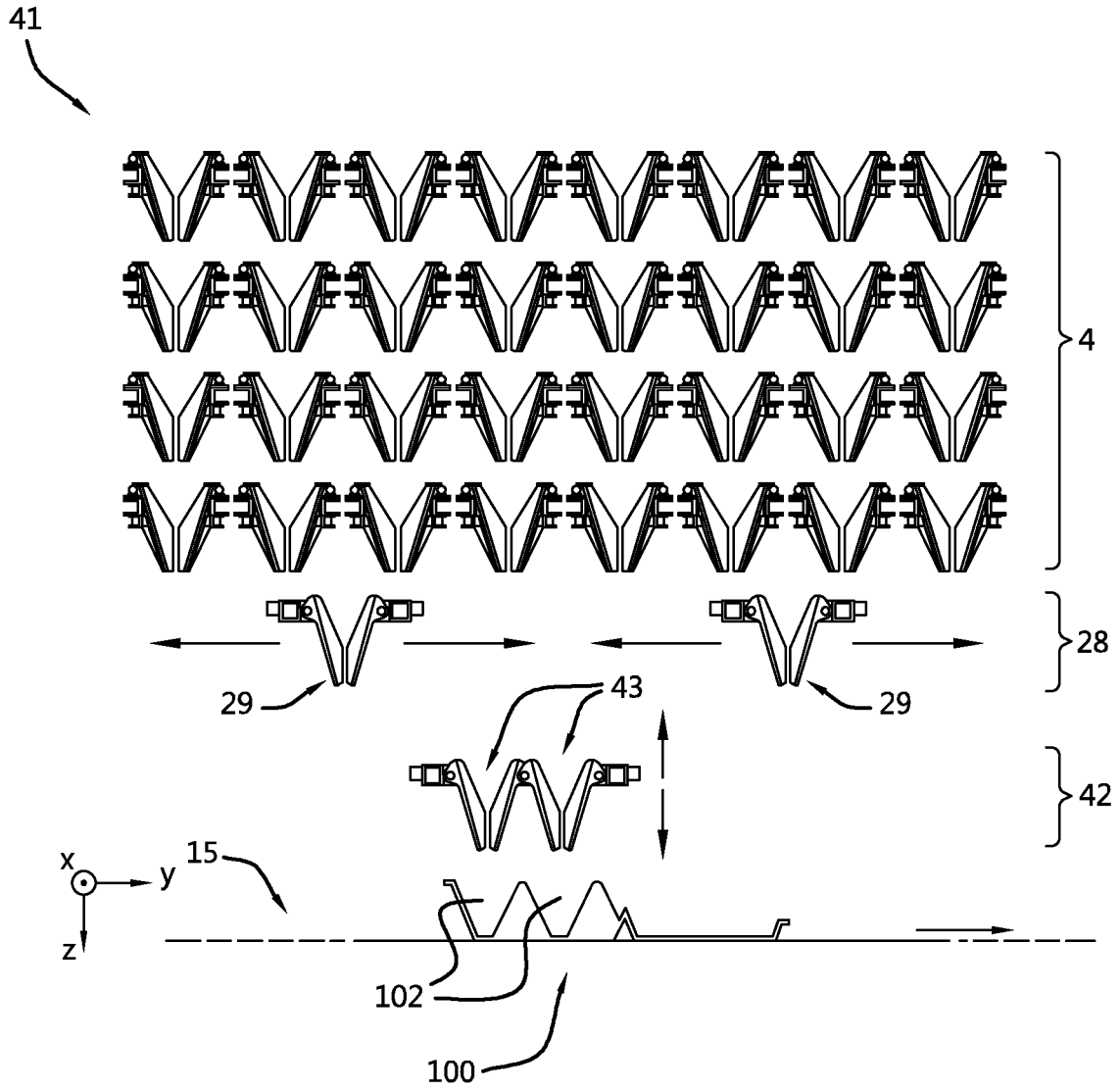
FIG. 4 shows a schematic view of a fourth embodiment of a packaging device according to the invention.

FIG. 4 shows a schematic front view of a fourth embodiment of a packaging device for packaging articles, in this case eggs, in a package 100. This packaging device 41 has the same components as the packaging device 31 of the third embodiment. The only difference is in the specific embodiment of the setter which will described below. The other components are the same and are indicated with the same reference numerals as in the third embodiment. For a description of those same components is referred to the above description of the first embodiment to the third embodiment.

The setter in the fourth embodiment is indicated by reference numeral 42. This setter has a plurality of setter rows 43, in the specific embodiment shown in FIG. 4 two setter rows 43. The rows 43 of said plurality of said rows are coupled to each other so as to move together. In this embodiment the pitch between the setter rows 43 is preferably the same as the pitch of the rows in the package 100, such that multiple package rows can be filled simultaneously.

Figure 5:
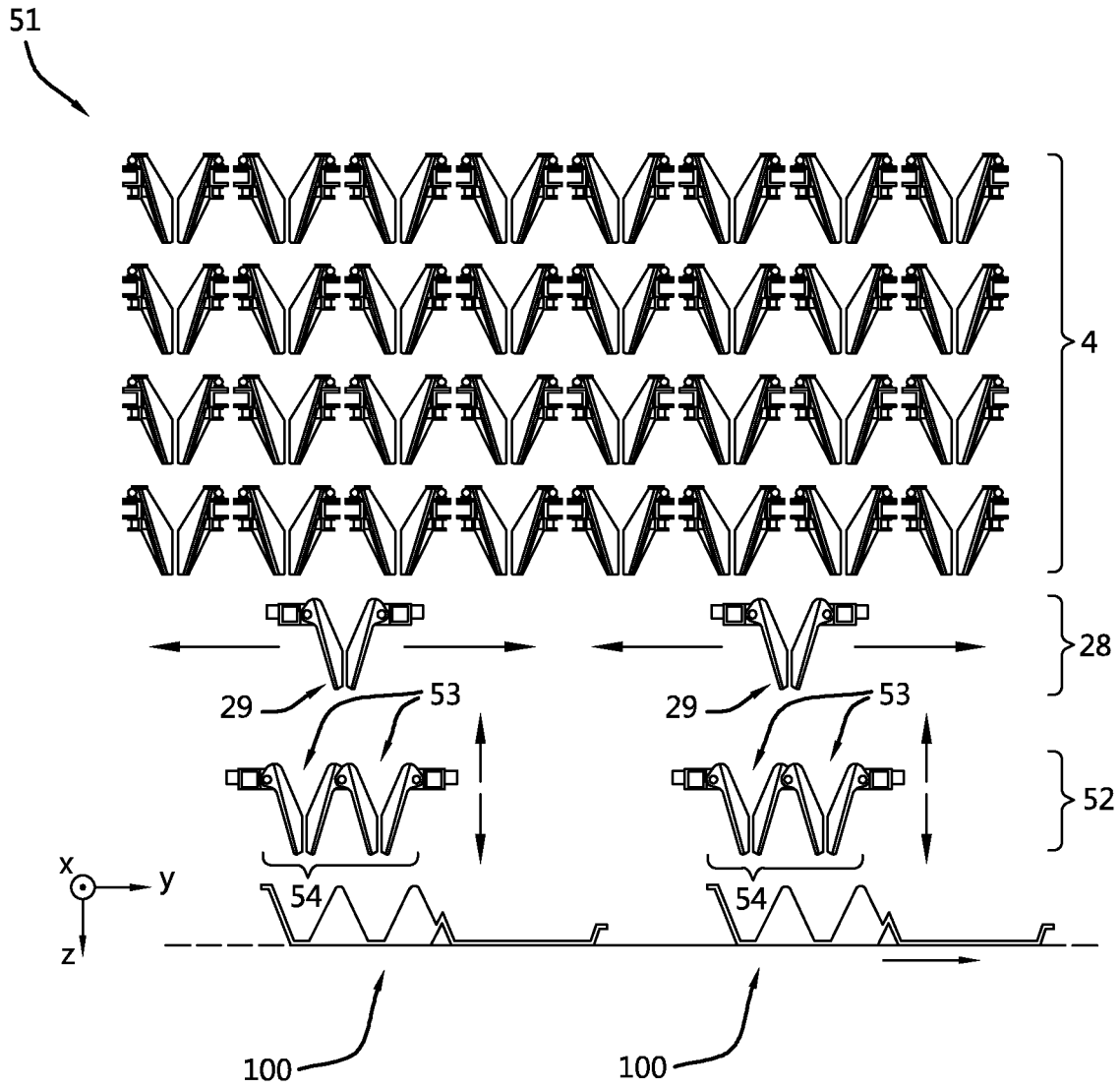
FIG. 5 shows a schematic view of a fifth embodiment of a packaging device according to the invention.

FIG. 5 shows a schematic front view of a fifth embodiment of a packaging device for packaging articles, in this case eggs, in a package 100. This packaging device 51 has the same components as the packaging device 41 of the fourth embodiment. The only difference is in the specific embodiment of the setter, which will described below. The other components are the same and are indicated with the same reference numerals as in the third embodiment.

For a description of those same components is referred to the above description of the first embodiment to the fourth embodiment.

The setter in the fifth embodiment is indicated by reference numeral 52. This setter 52 has a plurality of sets 54 of coupled setter rows 53, in the specific embodiment shown in FIG. 5 two pairs 54 of coupled setter rows 53. The rows 53 of said plurality of said rows are coupled to each other so as to move together. In this embodiment the pitch between the setter rows 53 of each pair the same as the pitch of the rows in the package 100, such that multiple package rows can be filled simultaneously by one pair 54 of coupled setter rows 53. Because there are multiple sets 54 (in FIG. 5 pairs) that are moveable independently from each other, different packages 100 can be filled simultaneously or consecutively.

Figure 6:
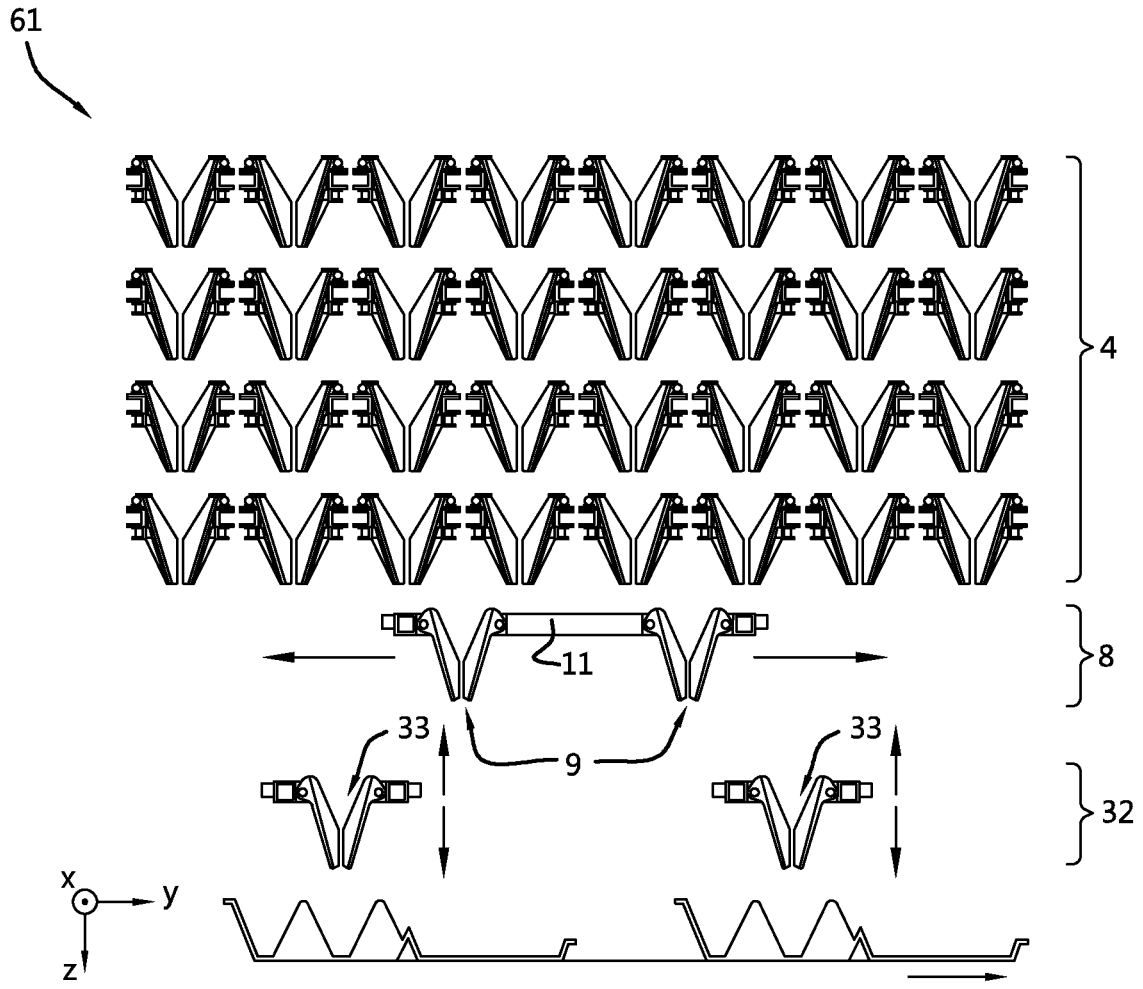
FIG. 6 shows a schematic view of a sixth embodiment of a packaging device according to the invention.

FIG. 6 shows a schematic front view of a sixth embodiment of a packaging device for packaging articles, in this case eggs, in a package 100. This packaging device 61 has the same components as the packaging device 1 of the first embodiment. The only difference is in the specific embodiment of the setter, which will described below. The other components are the same and are indicated with the same reference numerals as in the first embodiment. For a description of those same components is referred to the above description of the first embodiment.

The setter in the sixth embodiment, like the setter of the third embodiment, is indicated with reference numeral 32. Contrary to the setter 12 of the first embodiment, the setter 32 of the sixth embodiment has multiple rows 33, which are moveable in the Z-direction independently from each other.

By this sixth embodiment the rows of one package 100 but also the rows of different packages 100 placed on consecutive positions on the package conveyor 12 can be filled independently by the different setter rows 33.

Figure 7:
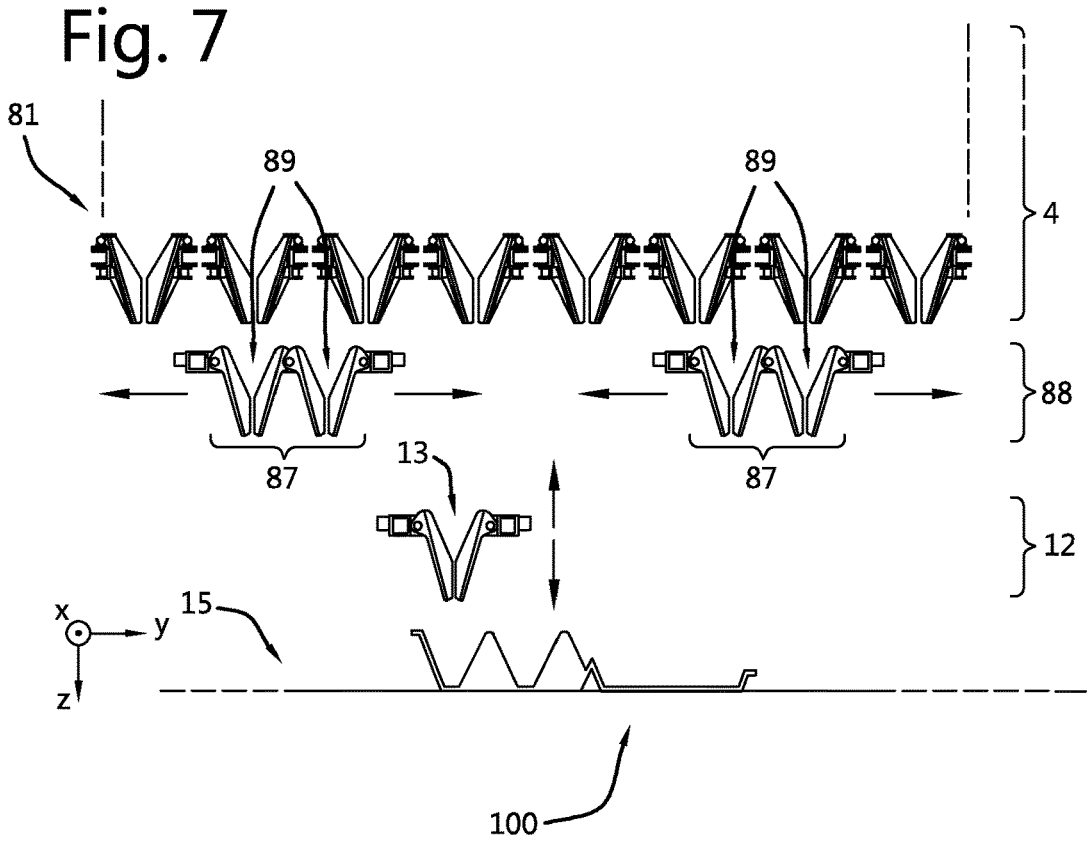
FIG. 7 shows a schematic view of a seventh embodiment of a packaging device according to the invention.

FIG. 7 shows a schematic front view of a seventh embodiment of a packaging device for packaging articles, in this case eggs, in a package 100. This packaging device 81 has the same components as the packaging device 21 of the second embodiment. The only difference is in the specific embodiment of the collector, which will described below. The other components are the same and are indicated with the same reference numerals as in the second embodiment. For a description of those same components is referred to the above description of the first embodiment and second embodiment.

The collector of the seventh embodiment is indicated with reference numeral 88. Contrary to the collector 28 of the second embodiment, the collector 88 of the seventh embodiment has multiple sets 87 of rows 89, which sets 87 are moveable in the Y-direction independently from each other. In the particular embodiment shown in FIG. 7 the collector 88 has two pairs 87 of rows. The rows 89 of each set 87 of rows are coupled to each other so as to move together.

The setter 12, just like in the second embodiment, has a single row 13 of pockets 14.

Figure 8:
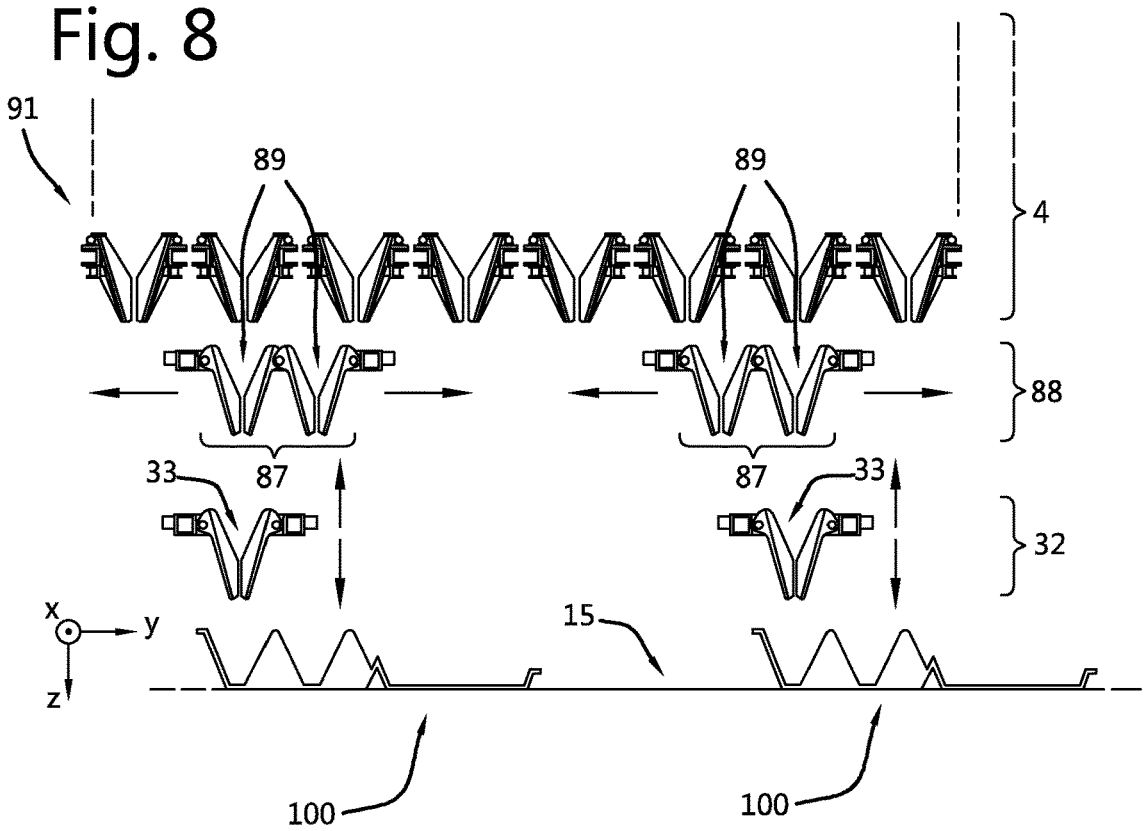
FIG. 8 shows a schematic view of an eighth embodiment of a packaging device according to the invention.

FIG. 8 shows a schematic front view of an eighth embodiment of a packaging device for packaging articles, in this case eggs, in a package 100. This packaging device 91 has the same components as the packaging device 81 of the seventh embodiment. The only difference is in the specific embodiment of the setter 32, which is the same as the setter 32 of the third embodiment, i.e. it has multiple rows, in particular two rows of pockets, which rows are movable in the Z-direction independently from each other.

Figure 9:
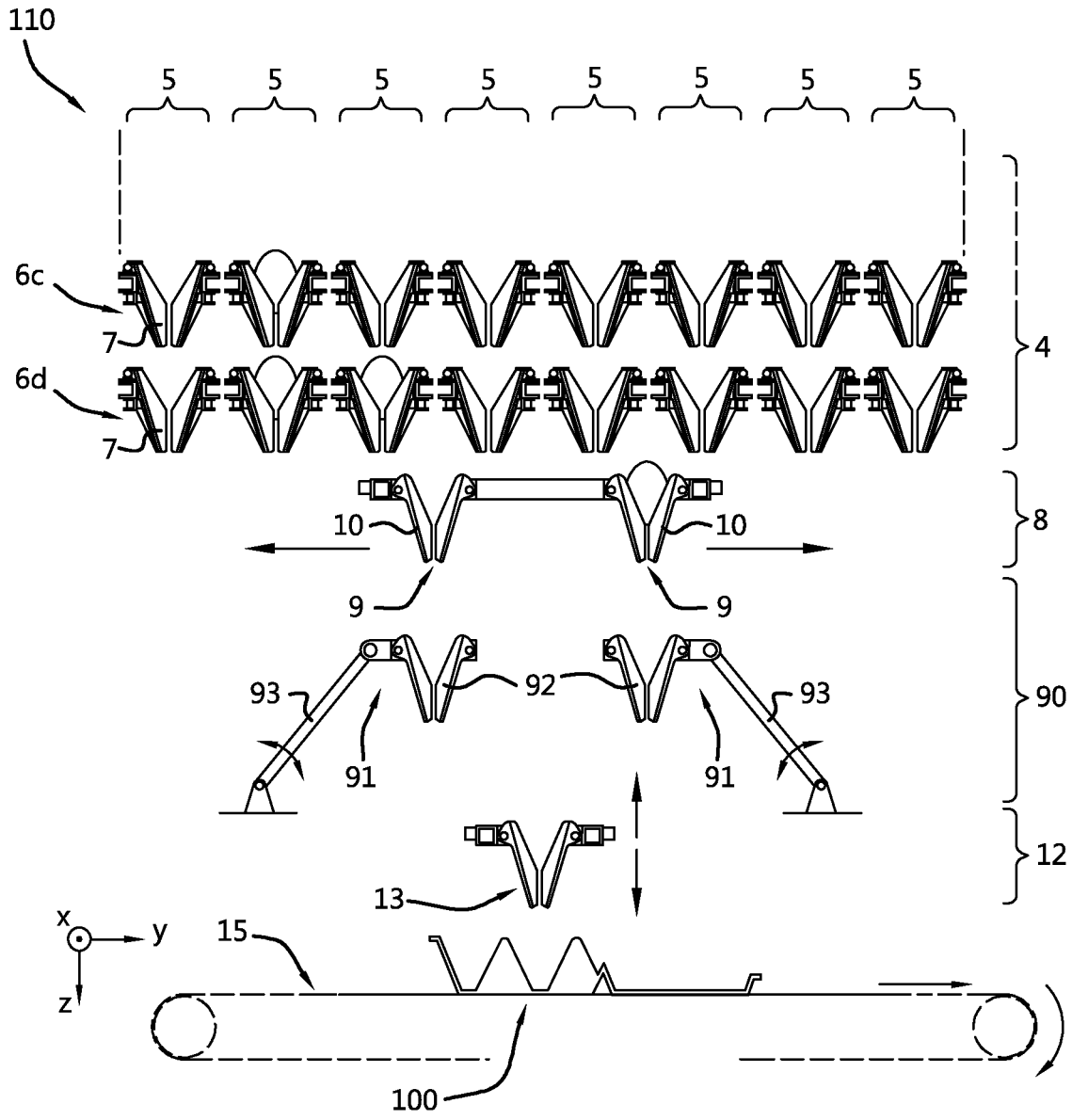
FIG. 9 shows a schematic view of an embodiment of yet another aspect of the invention.

FIG. 9 shows a packaging device 110 according to yet another aspect of the invention. This packaging device comprises a buffer 4, a collector 8 and a setter 12 which are comparable to the same parts in the packaging device shown in FIG. 1.

Figure 10:
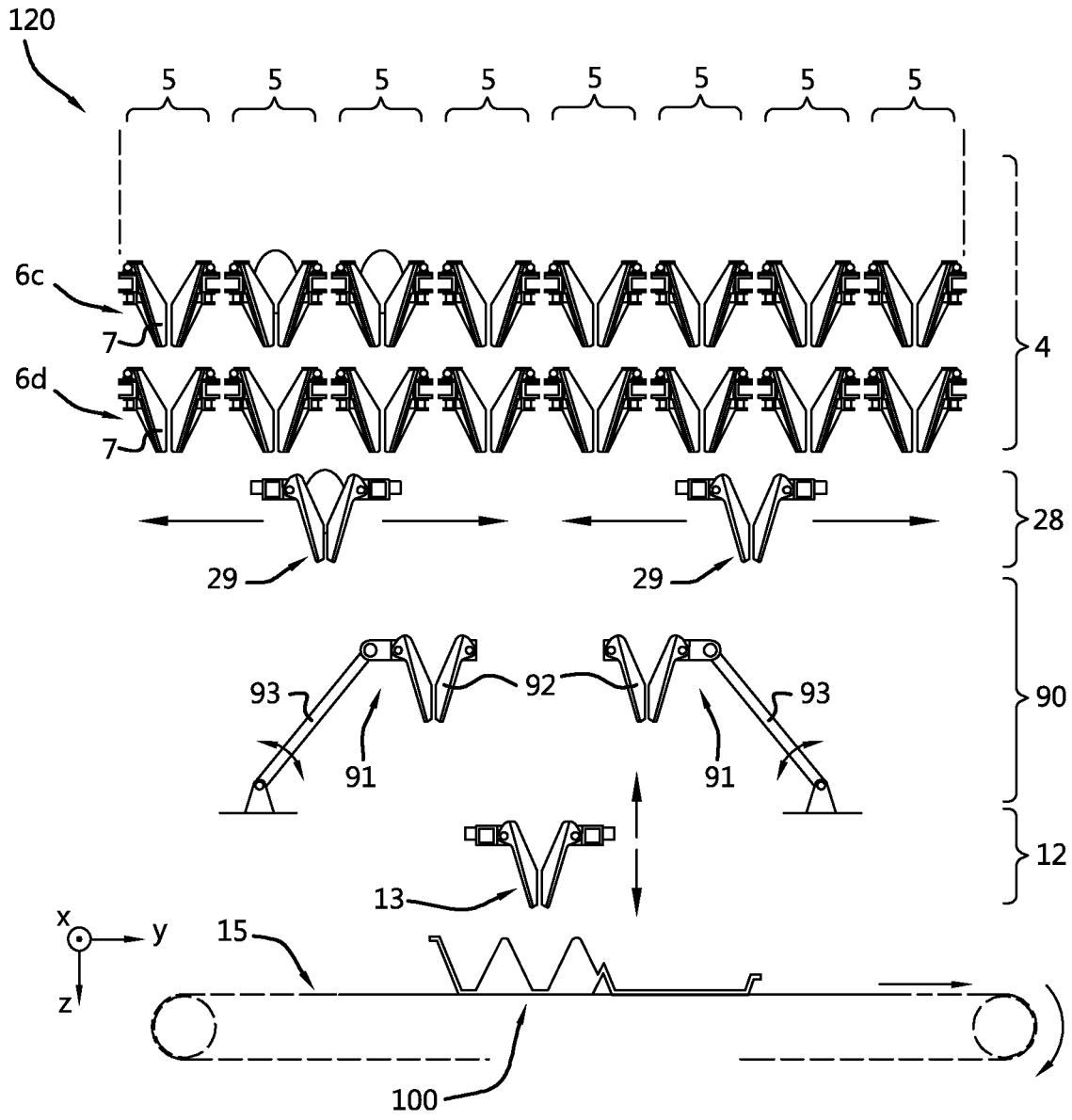
FIG. 10 shows a schematic view of another embodiment of this aspect of the invention.

The packaging device 110 also comprises a supply conveyor, a so called "egg chain" which is not shown in FIG. 10, but is the same as the supply conveyor 2 shown in FIG. 1 The supply conveyor 2 includes multiple rows of article holders 3 for releasably holding the eggs. Below the supply conveyor 2 the filling buffer 4 is arranged. In FIG. 9 only the lowest two rows 6*c* and 6*d* of the filling buffer 4 are shown. The filling buffer 4 is filled from above with articles by the supply conveyor 2. The filling buffer 4 comprises a plurality of parallel sub-buffers 5 positioned next to each other seen in the Y-direction. Each sub-buffer 5 has a plurality of stacked sub-buffer rows 6 of releasable buffer pockets 7. The sub-buffer rows 6 extend in the X-direction and each have a number of buffer pockets corresponding to the number of pockets in a package row extending in the X-direction. Alternatively each sub-buffer row 6 may have more buffer pockets than the number of pockets in a package row, which sub-buffer row is then partly used, i.e. not entirely filled with articles (eggs) by the control software. In the example in FIG. 9 the filling buffer 4 has six sub-buffers 5, and each sub-buffer 5 may have four stacked sub buffer rows 6*a*-6*d*, of which only the lowest two rows 6*c* and 6*d* are shown. In case of packaging eggs, each sub-buffer row 6*a*-6*d* may for example have five buffer pockets 7, when for example an egg carton 100 with five columns has to be filled.

The filling buffer 4 is stationary. It receives articles, for example eggs, in its upper rows 6*a* from the rows of the supply conveyor 2 which move along it (in the X-direction) and release the article from the respective article holders 3, when the respective article holders 3 are located above an empty pocket 7 of the upper row 6*a* of the corresponding sub-buffer 5.

The articles are passed on from the upper row 6*a* of the sub-buffer 5 to the row 6*b* below it by opening the pockets 7 and releasing the article to a pocket 7 in the row 6*b* directly below it (see FIG. 1). In the same manner the articles are passed on to the subsequent rows 6*c* below until the article arrives in the lowest row 6*d* of the sub-buffer 5. The buffer 4 is controlled such that an article is only released from a pocket 7 to a pocket 7 below it if the latter is empty and is able receive the article.

Below the buffer 4 a collector 8 is arranged. The collector 8 comprises a plurality of collector rows 9 of releasable pockets 10. In the specific embodiment of FIG. 9 the collector 8 has two collector rows 9 which are mechanically coupled, for example by one or more coupling members 11 (not shown in FIG. 9, but for example shown in FIG. 1).

Below the collector 8 an intermediate transfer device 90 is arranged.

Below the intermediate transfer device 90 a setter 12 is arranged. The setter 12 in the specific embodiment of FIG. 9 comprises a single row 13 of releasable pockets 14 defining a setter row 13. The setter row 13 is movable up and down in a Z-direction perpendicular to the X-direction and Y-direction.

The intermediate transfer device 90 comprises in the embodiment shown in FIG. 9 two transfer rows 91 of releasable pockets 92. The transfer rows 91 are each arranged on a corresponding swivelling arm 93 whereby the movement of the transfer rows 91 is a swivelling movement. The swivelling movement is composed of a movement in the second direction (Y) and the third direction (Z).

It should be noted here, that also another guiding mechanism than a swivelling arm may be used to establish a composed movement in the second direction (Y) and third direction (Z) of the transfer rows.

The intermediate transfer device 90 is configured and arranged to move the transfer rows 91 back and forth from a position under the collector, for receiving articles from the collector, to a position above the setter row 13 to discharge the articles into the setter 12. The transfer rows 91 of the intermediate transfer device 90 thus alternately fill the setter row 13, but it is also possible that the same transfer row 91 fills the setter row 13 multiple times in succession. The collector rows 9 can each fill any of the transfer rows 91 of the intermediate transfer device 90.

Below the setter 12 a package conveyor 15 is located. This may be and endless conveyor such as a belt conveyor on which packages 100 are placed and conveyed in the Y-direction past the setter 12. The packages 100 are oriented on the package conveyor 15 such that the rows of the package 100 extend in the X-direction and the columns of the package 100 extend in the Y-direction.

In use, the setter 12 reciprocates between an upper position to a lower position, wherein in the upper position the articles can be received from the transfer rows 91 and in the lower position the articles can be discharged into the pockets 102 of the package 100 that is positioned by the package conveyor 15 with one package row below the setter row 13.

In FIG. 10 another embodiment of a packaging device including a transfer device is shown. This packaging device 120 comprises basically the same components as the packaging device 110 shown in FIG. 9. The difference is that the collector 28, contrary to the collector 8 of the embodiment of FIG. 9, has multiple rows 29, which are moveable in the Y-direction independently from each other. In particular in the embodiment of FIG. 10 the collector has two independently moveable rows 29. It is thus comparable to the collector of FIG. 2.

In this embodiment the collector rows 29 are moved selectively and independent from each other to a sub-buffer 5 with a full lower row 6*d*. In this embodiment the device 21 can have a separate driving mechanism for each collector row 29 or a common driving mechanism with a selective driving transmission. If for example the collector 28 has two collector rows, as is shown in the example of FIG. 10, one of the collector rows 29 can hold articles and be moved towards one of the transfer rows 91 of the transfer device, while the other collector row 29 is empty because it discharged articles just before. Thus while the one collector row 29 is moved to discharge the articles in one of the transfer rows 91 the other collector row 29 can in the meantime be moved towards a sub-buffer 5 with a filled lower row 6*d*. This increases the rate at which the articles can be packed and thus the throughput time of the packages 100.

It is envisaged that the independently moveable collector rows 29 move in the same plane. Therefore an embodiment is envisaged in which a controller, that controls the movement of the collector rows 29, is configured such that it prevents the rows 29 from colliding.

Figure 11:
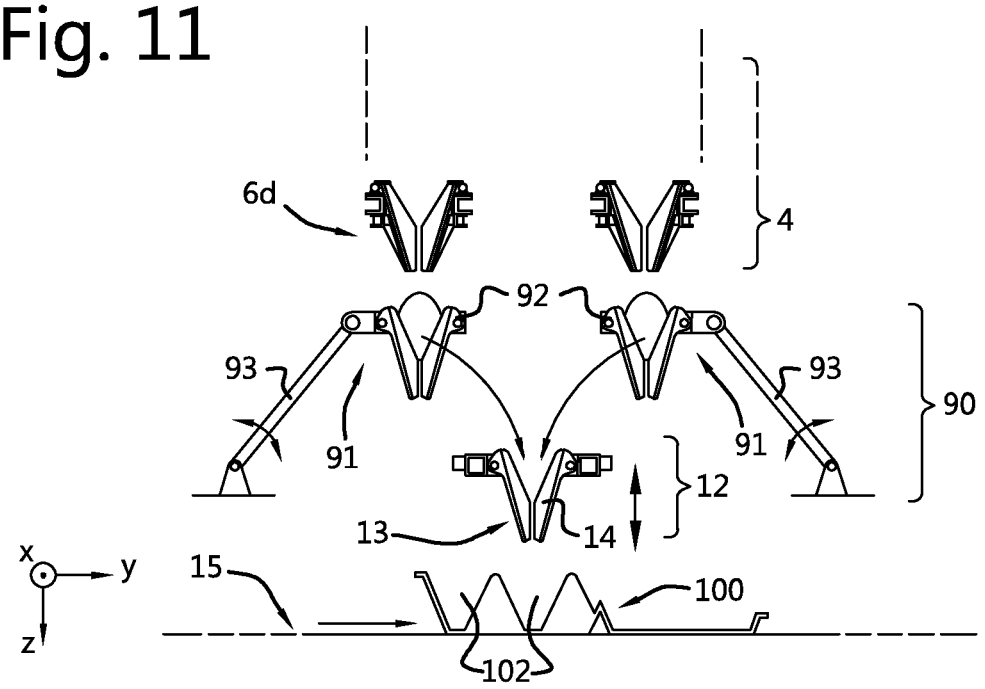
FIG. 11 shows a schematic view of an embodiment of another aspect of the invention.

FIG. 11 shows part of an embodiment of a packaging device for articles, such as eggs, according to another aspect of the invention.

Using the reference numerals from the embodiment of FIG. 1 for the same components the packaging device according to this aspect comprises a supply conveyor 2 (not shown in FIG. 11) for conveying the articles in a first direction (X) and having object holders 3 for releasably holding the articles, which are, in the specific example shown, eggs.

A package conveyor 15 is located below the supply conveyor for conveying the packages 100 in a second direction (Y) substantially perpendicular to the first direction (X), the packages 100 being oriented on the package conveyor such that the rows of the package 100 extend in the first direction (X) and the columns of the package 100 extend in the second direction (Y).

A filling buffer 4 is located between the supply conveyor 2 and the package conveyor 15. The filling buffer 4 in use is filled from above with articles by the supply conveyor 2 and fills the packages 100 on the package conveyor 15 located below the buffer 4 with said articles (eggs) indirectly via an intermediate mechanism.

The filling buffer 4 comprises a plurality of parallel sub-buffers 5 positioned next to each other seen in the second direction (Y). Each sub-buffer 5 has a plurality of stacked sub-buffer rows 6*a*-6*d* of releasable buffer pockets 7. The sub-buffer rows 6*a*6*d* extend in the first direction (X). Each sub buffer row 6*a*-6*d* has a number of buffer pockets 7 corresponding to the number of pockets 102 in a package row extending in the first direction (X). As mentioned before it is also possible that each sub buffer row has a number of buffer pockets 7 that exceeds to the number of pockets 102 in a package row extending in the first direction (X), which sub buffer row is then only partly filled, in accordance with the size of the package, by the control software.

Referring now to FIG. 11, the packaging device according to this aspect is based on the notion that if the egg chain 2 (see FIG. 1) only has two rows, and thus the filling buffer 4 only has two sub-buffers 5, a collector 8, 28 as is shown in the embodiments of FIGS. 9 and 10 can be omitted. In a packaging device according to this aspect the eggs (or other articles) can be released directly from the lowest row 6*d* of the sub-buffers 5 into the releasable pockets 91 of the transfer rows 92 of the transfer device 90.

A setter 12 comprising a row of releasable pockets 14 defining a setter row 13 which is movable up and down in a third direction (Z) perpendicular to the first direction (X) and second direction (Y), is located below the transfer device 90. In use, the setter 12 reciprocates between an upper position to a lower position, wherein in the upper position the articles can be received from the transfer device 90 and in the lower position the articles can be discharged into the pockets 102 of the package 100.

The setter 12 comprises a setter row 13 associated with said pair of transfer rows 91. The transfer device 90 is configured and arranged to move each one of the transfer rows 91 of the pair back and forth from a position under a sub-buffer 5 associated with said transfer row 91 for receiving articles from the lowest row 6*d* of said sub-buffer 5, to a position above the setter row 13 to discharge the articles into the setter 12.

In the specific embodiment shown, the transfer rows 91 of said pair are each arranged on a corresponding swivelling arm 93 whereby the movement of the transfer rows 91 is a swivelling movement. The swivelling movement is composed of a movement in the second direction (Y) and the third direction (Z).

It must be noted here, that also another guiding mechanism than a swivelling arm can be used to establish a composed movement in the second direction (Y) and third direction (Z) of the transfer rows.

As mentioned the transfer mechanism 90 is configured and arranged to move the transfer rows 91 back and forth from a position under the associated sub-buffer 5, for receiving articles from the lowest row 6*d* thereof, to a position above the setter row 13 to discharge the articles into the setter 12. The transfer rows 91 of the pair can thus alternately fill the setter row 13, but it is also possible that the same transfer row 91 fills the setter row 13 multiple times in succession.

In an alternative embodiment, which is not shown in the figures, the packaging device of FIG. 11 is modified by omitting the setter 12. In this embodiment the transfer rows can move back and forth, in the manner as described in the above, between the lowest row of the sub-buffer 5 for receiving articles to a position above a package row to discharge the articles directly into the pockets 102 of the package 100.

In the embodiments shown in the figures the collector may have independently moveable collector rows or coupled collector rows. Also the setter may have independently moveable setter rows or coupled setter rows, or even a single setter row. It must be understood that within the scope of the invention there are more combinations of coupled, independent or single setter rows with coupled or independent collector rows than are now shown in the figures. The embodiments in the figures are thus to be considered as non-limiting examples.

The invention claimed is:

1. A packaging device for packaging substantially round articles, such as eggs or fruit, into a dimpled package having an array of pockets to receive the round articles, wherein said array comprises rows and columns, the packaging device comprising:

a supply conveyor for conveying the articles in a first direction (X) and having article holders for releasably holding the articles;

a package conveyor located below the supply conveyor for conveying the packages in a second direction (Y) substantially perpendicular to the first direction (X), the packages being oriented on the package conveyor such that the rows of the package extend in the first direction (X) and the columns of the package extend in the second direction (Y);

a filling buffer located between the supply conveyor and the package conveyor, wherein the filling buffer in use is filled from above with articles by the supply conveyor and fills the packages on the package conveyor located below the buffer with said articles, the filling buffer comprising a plurality of parallel sub-buffers positioned next to each other seen in the second direction (Y), each sub-buffer has a plurality of stacked sub-buffer rows of releasable buffer pockets, said sub-buffer rows extending in the first direction (X) and each having a number of buffer pockets equal or greater than the number of pockets in a package row extending in the first direction (X);

a collector comprising a row of releasable pockets defining a collector row which extends in the first direction (X) is movable in the second direction (Y); and a setter comprising a row of releasable pockets defining a setter row which is movable up and down in a third direction (Z) perpendicular to the first direction (X) and second direction (Y), wherein, in use, the setter reciprocates between an upper position to a lower position, wherein in the upper position the articles can be received from the collector and in the lower position the articles can be discharged into the pockets of the package;

wherein the collector comprises a plurality of collector rows, wherein the collector is configured and arranged to move each one of the plurality of collector rows back and forth in the second direction (Y) underneath the filling buffer to a position under any one of the sub-buffers for receiving articles from the lowest row thereof, wherein each one of the collector rows can be moved selectively to align with any one of the sub-buffers and to move back and forth in the second direction (Y) with filled pockets to a position above the setter to discharge the articles into the setter, wherein the collector rows of said plurality of collector rows are coupled to each other so as to move together.

2. The packaging device according to claim 1, wherein the collector rows of said plurality of collector rows are coupled to each other so as to move together.

3. The packaging device according to claim 1, wherein the setter has a single setter row.

4. A packaging device for packaging substantially round articles, such as eggs or fruit, into a dimpled package having an array of pockets to receive the round articles, wherein said array comprises rows and columns, the packaging device comprising:

a supply conveyor for conveying the articles in a first direction (X) and having object holders for releasably holding the articles;

a package conveyor located below the supply conveyor for conveying the packages in a second direction (Y) substantially perpendicular to the first direction (X), the packages being oriented on the package conveyor such that the rows of the package extend in the first direction (X) and the columns of the package extend in the second direction (Y);

a filling buffer located between the supply conveyor and the package conveyor, wherein the filling buffer in use is filled from above with articles by the supply conveyor and fills the packages on the package conveyor located below the buffer with said articles, the filling buffer comprising a plurality of parallel sub-buffers positioned next to each other seen in the second direction (Y), each sub-buffer has a plurality of stacked sub-buffer rows of releasable buffer pockets, said sub-buffer rows extending in the first direction (X) and each having a number of buffer pockets equal or greater than the number of pockets in a package row extending in the first direction (X);

a collector comprising at least one row of releasable pockets defining a collector row which is movable in the second direction (Y); and a setter comprising a row of releasable pockets defining a setter row which is movable up and down in a third direction (Z) perpendicular to the first direction (X) and second direction (Y), wherein, in use, the setter reciprocates between an upper position to a lower position, wherein in the upper position the articles can be received from above and in the lower position the articles can be discharged into the pockets of the package;

wherein an intermediate transfer device is arranged between the collector and the setter, said intermediate transfer device comprising at least one transfer row of releasable pockets, said intermediate transfer device being configured and arranged to move the transfer row back and forth from a position under the at least one collector row for receiving articles to a position above the setter row to discharge the articles into the setter.

5. The packaging device according to claim 4, wherein the transfer device comprises at least one pair of transfer rows wherein the transfer device is configured and arranged to move each one of the transfer rows of the pair back and forth from a position under said at least one collector row for receiving articles therefrom, to a position above the setter row to discharge the articles into the setter.

6. The packaging device according to claim 5, wherein the collector comprises at least two collector rows.

7. The packaging device according to claim 6, wherein the collector rows are coupled so as to move in the second direction (Y) together.

8. The packaging device according to claim 4, wherein the transfer rows of said pair are each arranged on a corresponding guiding mechanism whereby the movement of the transfer rows is a combined movement, which is composed of a movement in the second direction (Y) and the third direction (Z).

9. The packaging device according to claim 8, wherein the guiding mechanism includes a swivelling arm.

10. The packaging device according to claim 4, wherein the pitch between the pockets of the at least one transfer row of releasable pockets is variable in the first direction (X) such that it can be adapted to the pitch of the at least one collector row for receiving the articles and to the pitch of the setter row for discharging the articles.

11. The packaging device according to claim 10, wherein the pitch is varied during the movement from the position under the collector to the position above the setter and vice versa.

12. A packaging device for packaging substantially round articles, such as eggs or fruit, into a dimpled package having an array of pockets to receive the round articles, wherein said array comprises rows and columns, the packaging device comprising:

a supply conveyor for conveying the articles in a first direction (X) and having object holders for releasably holding the articles;

a package conveyor located below the supply conveyor for conveying the packages in a second direction (Y) substantially perpendicular to the first direction (X), the packages being oriented on the package conveyor such that the rows of the package extend in the first direction (X) and the columns of the package extend in the second direction (Y);

a filling buffer located between the supply conveyor and the package conveyor, wherein the filling buffer in use is filled from above with articles by the supply conveyor and fills the packages on the package conveyor located below the buffer with said articles, the filling buffer comprising a plurality of parallel sub-buffers positioned next to each other seen in the second direction (Y), each sub-buffer has a plurality of stacked sub-buffer rows of releasable buffer pockets, said sub-buffer rows extending in the first direction (X) and each having a number of buffer pockets equal or greater than the number of pockets in a package row extending in the first direction (X);

a setter comprising a row of releasable pockets defining a setter row which is movable up and down in a third direction (Z) perpendicular to the first direction (X) and second direction (Y), wherein, in use, the setter reciprocates between an upper position to a lower position, wherein in the upper position the articles can be received and in the lower position the articles can be discharged into the pockets of the package;

wherein the packaging device furthermore comprises a transfer device comprising at least one pair of transfer rows of releasable pockets, and the setter row being associated with said pair of transfer rows, wherein the transfer device is configured and arranged to move each one of the transfer rows of the pair back and forth from a position under a sub-buffer associated with said transfer row for receiving articles from the lowest row of said sub-buffer, to a position above the setter row to discharge the articles into the setter, wherein the transfer rows of said pair are each arranged on a corresponding guiding mechanism whereby the movement of the collector rows is a combined movement, which is composed of a movement in the second direction (Y) and the third direction (Z) wherein the guiding mechanism includes a swivelling arm.

13. The packaging device according to claim 12, wherein the pitch between the pockets of the at least one pair of transfer rows of releasable pockets is variable in the first direction (X) such that it can be adapted to the pitch of the corresponding sub-buffer of the filling buffer for receiving the articles and to the pitch of the setter row for discharging the articles.

14. The packaging device according to claim 13, wherein the pitch is varied during the movement from the position under the sub-buffer to the position above the setter and vice versa.

15. A packaging device for packaging substantially round articles, such as eggs or fruit, into a dimpled package having an array of pockets to receive the round articles, wherein said array comprises rows and columns, the packaging device comprising:

a supply conveyor for conveying the articles in a first direction (X) and having object holders for releasably holding the articles;

a package conveyor located below the supply conveyor for conveying the packages in a second direction (Y) substantially perpendicular to the first direction (X), the packages being oriented on the package conveyor such that the rows of the package extend in the first direction (X) and the columns of the package extend in the second direction (Y);

a filling buffer located between the supply conveyor and the package conveyor, wherein the filling buffer in use is filled from above with articles by the supply conveyor and fills the packages on the package conveyor located below the buffer with said articles, the filling buffer comprising a plurality of parallel sub-buffers positioned next to each other seen in the second direction (Y), each sub-buffer has a plurality of stacked sub-buffer rows of releasable buffer pockets, said sub-buffer rows extending in the first direction (X) and each having a number of buffer pockets equal or greater than the number of pockets in a package row extending in the first direction (X);

wherein the packaging device furthermore comprises a transfer device comprising at least one pair of transfer rows of releasable pockets, and the package comprises a package row associated with said pair of transfer rows, wherein the transfer device is configured and arranged to move each one of the transfer rows of the pair back and forth from a position under a sub-buffer associated with said transfer row for receiving articles from the lowest row of said sub-buffer, to a position above the package row to discharge the articles into the package, wherein the transfer rows of said pair are each arranged on a corresponding guiding mechanism whereby the movement of the collector rows is a combined movement, which is composed of a movement in the second direction (Y) and the third direction (Z) wherein the guiding mechanism includes a swivelling arm.

16. The packaging device according to claim 15, wherein the pitch between the pockets of the at least one pair of transfer rows of releasable pockets is variable in the first direction (X) such that it can be adapted to the pitch of the corresponding sub-buffer of the filling buffer for receiving the articles and to the pitch of the package row for discharging the articles.

17. The packaging device according to claim 16, wherein the pitch is varied during the movement from the position under the sub-buffer to the position above the package row and vice versa.

18. A packaging device for packaging substantially round articles, such as eggs or fruit, into a dimpled package having an array of pockets to receive the round articles, wherein said array comprises rows and columns, the packaging device comprising:

a supply conveyor for conveying the articles in a first direction (X) and having article holders for releasably holding the articles;

a package conveyor located below the supply conveyor for conveying the packages in a second direction (Y) substantially perpendicular to the first direction (X), the packages being oriented on the package conveyor such that the rows of the package extend in the first direction (X) and the columns of the package extend in the second direction (Y);

a filling buffer located between the supply conveyor and the package conveyor, wherein the filling buffer in use is filled from above with articles by the supply conveyor and fills the packages on the package conveyor located below the buffer with said articles, the filling buffer comprising a plurality of parallel sub-buffers positioned next to each other seen in the second direction (Y), each sub-buffer has a plurality of stacked sub-buffer rows of releasable buffer pockets, said sub-buffer rows extending in the first direction (X) and each having a number of buffer pockets equal or greater than the number of pockets in a package row extending in the first direction (X);

a collector comprising a row of releasable pockets defining a collector row which is movable in the second direction (Y); and a setter comprising a row of releasable pockets defining a setter row which is movable up and down in a third direction (Z) perpendicular to the first direction (X) and second direction (Y), wherein, in use, the setter reciprocates between an upper position to a lower position, wherein in the upper position the articles can be received from the collector and in the lower position the articles can be discharged into the pockets of the package;

wherein the collector comprises a plurality of collector rows, wherein the collector is configured and arranged to move each one of the plurality of collector rows back and forth in the second direction (Y) underneath the filling buffer to a position under any one of the sub-buffers for receiving articles from the lowest row thereof, wherein each one of the collector rows can be independently moved selectively to align with any one of the sub-buffers and to move back and forth in the second direction (Y) with filled pockets to a position above the setter to discharge the articles into the setter.

* * * * *